US009869141B2

(12) United States Patent
Chang

(10) Patent No.: US 9,869,141 B2
(45) Date of Patent: Jan. 16, 2018

(54) DOWNHOLE TOOL VIBRATION DEVICE AND METHOD

(75) Inventor: Chung Chang, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 296 days.

(21) Appl. No.: 14/414,609

(22) PCT Filed: Jul. 26, 2012

(86) PCT No.: PCT/US2012/048310

§ 371 (c)(1),
(2), (4) Date: Jan. 13, 2015

(87) PCT Pub. No.: WO2014/018040

PCT Pub. Date: Jan. 30, 2014

(65) Prior Publication Data

US 2015/0167402 A1 Jun. 18, 2015

(51) Int. Cl.

| | |
|---|---|
| ***E21B 17/10*** | (2006.01) |
| ***E21B 19/16*** | (2006.01) |
| ***E21B 47/09*** | (2012.01) |

(52) U.S. Cl.

CPC ..... *E21B 17/1057* (2013.01); *E21B 17/1014* (2013.01); *E21B 19/16* (2013.01); *E21B 47/09* (2013.01)

(58) Field of Classification Search

CPC .. E21B 17/1057; E21B 17/1014; E21B 47/09; E21B 19/16

See application file for complete search history.

(56) References Cited

U.S. PATENT DOCUMENTS

| | | | | |
|---|---|---|---|---|
| 3,831,443 | A | 8/1974 | Planche et al. | |
| 4,192,380 | A | 3/1980 | Smith | |
| 4,303,270 | A * | 12/1981 | Adair | E21B 19/155 294/119.1 |
| 4,958,692 | A | 9/1990 | Anderson | |
| 5,358,042 | A | 10/1994 | Stoltz | |
| 6,250,394 | B1 | 6/2001 | Mashburn | |
| 6,257,356 | B1 | 7/2001 | Wassell | |
| 6,739,409 | B2 | 5/2004 | Kruspe et al. | |
| 7,219,752 | B2 | 5/2007 | Wassell | |
| 2003/0159834 | A1 | 8/2003 | Kirk et al. | |

(Continued)

OTHER PUBLICATIONS

"Australian Application Serial No. 2012386004, Response filed Mar. 2, 2016 to First Examiner Report dated Oct. 30, 2015", 49 pgs.

(Continued)

*Primary Examiner* — Yong-Suk Ro

(74) *Attorney, Agent, or Firm* — Haynes and Boone, LLP

(57) ABSTRACT

In some embodiments, an apparatus and a system, as well as a method and an article, may operate to select a longitudinal axis within a borehole, and to move a down hole housing using at least one set of rollers attached to the housing to contact a surface of the borehole, so that simultaneous movement with two rotational degrees of freedom is enabled within the borehole. The centerline of the housing can be substantially aligned with a selected longitudinal axis while the housing moves along the selected longitudinal axis. Additional apparatus, systems, and methods are disclosed.

23 Claims, 7 Drawing Sheets

(56) References Cited

U.S. PATENT DOCUMENTS

2010/0276138 A1 11/2010 Wittman et al.

OTHER PUBLICATIONS

"Australian Application Serial No. 2012386004, Subsequent Examiners Report dated Apr. 14, 2016", 3 pgs.
"Canadian Application Serial No. 2,879,612, Response filed May 27, 2016 to Office Action dated Dec. 23, 2015", 7 pgs.
"Australian Application Serial No. 2012386004, Second Statement of Proposed Amendments filed Sep. 26, 2016 in response to Subsequent Examiners Report dated Apr. 14, 2016", 26 pgs.
"International Application Serial No. PCT/US2012/048310, International Search Report dated Feb. 27, 2013", 5 pgs.
"International Application Serial No. PCT/US2012/048310, Written Opinion dated Feb. 27, 2013", 6 pgs.
Brunhorn, Jochen, et al., "A Novel Omnidirectional Wheel Based on Reuleaux-Triangles", RoboCup 2006: Robot Soccer World Cup X, (2007), 516-522.
Rojas, R., "A short history of omnidirectional wheels", [online]. [archived Jul. 12, 2007]. Retrieved from the Internet: <URL: http://web.archive.org/web/20070712165801/http://robocup.mi.fu-berlin.de/buch/shortomni.pdf>, (2007), 4 pgs.
"Active Vibration Damper Sub (AVD tm)", [online]. [retrieved on Aug. 2, 2011]. Retrieved from the Internet: <URL: https://web.archive.org/web/20110802030812/http://www.aps-tech.com/vibration/active_vibration_damper.htm>, (2011), 2 pgs.
"Australian Application Serial No. 2012386004, First Examiner Report dated Oct. 30, 2015", 3 pgs.
"Canadian Application Serial No. 2,879,612, Office Action dated Dec. 23, 2015", 4 pgs.
"European Application Serial No. 12745737.2, Office Action dated May 11, 2015", 2 pgs.
"European Application Serial No. 12745737.2, Response filed Nov. 5, 2015 to Office Action dated May 11, 2015", 11 pgs.
"International Application Serial No. PCT/US2012/048310, International Preliminary Report on Patentability dated Feb. 5, 2015", 8 pgs.

* cited by examiner

DOWNHOLE TOOL VIBRATION DEVICE AND METHOD

PRIORITY APPLICATIONS

This application is a U.S. National Stage Filing under 35 U.S.C. 371 from International Application No. PCT/US2012/048310, filed on 26 Jul. 2012, and published as WO 2014/018040 A1 on 30 Jan. 2014; which application and publication are incorporated herein by reference in their entirety.

BACKGROUND

Understanding the structure and properties of geological formations can reduce the cost of drilling wells for oil and gas exploration. Measurements made in a borehole (i.e., down hole measurements) are typically performed to attain this understanding, to identify the composition and distribution of materials that surround the measurement device down hole. However, measurement tool vibrations not only reduce the reliability and increase the cost of down hole tools, but also lower the quality of their measurements. For example, some of the measurement technologies that are used, including NMR (nuclear magnetic resonance) imaging and LWD (logging while drilling) sonic measurements, are sensitive to the vibration caused by drilling and other down hole activities.

Thus, if one is able to reduce the magnitude of these vibrations, the quality of MWD (measurement while drilling) and LWD (logging while drilling) measurements may be significantly improved. Reduced vibration may also improve penetration speed and overall borehole quality. To this end, stabilizers are often put in place along the drill string. However, conventional stabilizers are of generally simple mechanical construction, and not readily adaptable to the variations of hole sizes experienced down hole. Those having improved capabilities are often expensive to manufacture.

DETAILED DESCRIPTION

The technology of directional drilling has matured to become the dominant practice. Some embodiments of the invention described herein thus attempt to simplify the mechanical control of a rotary steerable drilling system and improve its efficiency, as well as reduce its cost. To address some of these challenges, as well as others, apparatus, systems, and methods are therefore described herein to manage vibrations around the rotation (e.g., centerline or longitudinal) axis of a housing deployed down hole, during wireline and drilling operations. In some cases, the management is active, so that a chosen axis within a borehole is maintained using feedback-based alignment, even when vibration is present.

In many embodiments, a dynamic centralizer with feedback control sensors may be used to stabilize the rotating axis of the housing (e.g., of a down hole tool) before taking data. Various embodiments provide solid contact between the centralizer and the borehole surface, while permitting two degrees of movement freedom—vertically, along the chosen longitudinal axis, and azimuthally, around the same axis.

To enable this freedom of movement, one or more omnidirectional wheels having one or more sets of rollers may be employed. Those of ordinary skill in the art are familiar with this type of wheel. Others that desire additional information may refer to "An Omnidirectional Wheel Based on Reuleaux Triangles", by Brunhorn et al., RoboCup 2006: Robot Soccer World Cup X. Bremen, pp. 516-512, June 2006. Omnidirectional wheels can be purchased from several suppliers, including AndyMark Inc. of Kokomo, Ind. Using such wheels according the manner described herein provides a platform to stabilize the tool rotational axis, improving measurement quality and other aspects of down hole performance.

As will be described in more detail below, omnidirectional wheels can be used to accommodate the advancing motions of down hole tools, with feedback control and dampers to quickly stabilize the tool housing rotational axis against vibration, such as drilling vibration. Because omnidirectional wheels allow for motion with two degrees of freedom, substantial contact between the borehole wall and the centralizer can be maintained without slipping. In addition, feedback control sensors on the centralizer arm(s) can be used to stabilize the rotating axis of the housing to improve NMR and sonic measurement quality, for example. Various example embodiments, some of which provide significant advantages over conventional stabilizers, will now be described in detail.

Figure 1A:
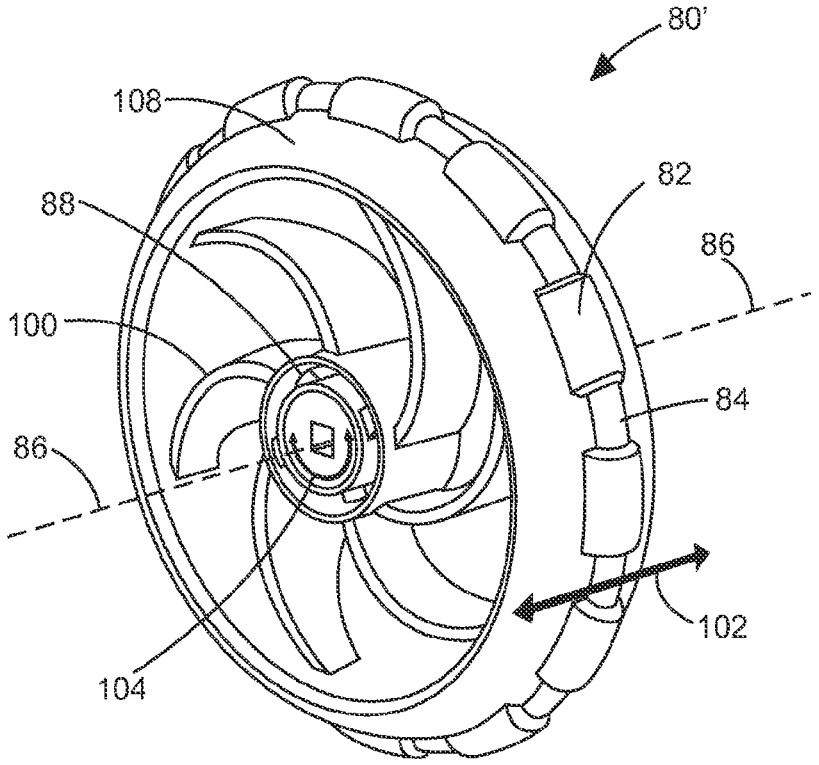
FIGS. 1A-1B illustrate sets of rollers in perspective view, according to various embodiments of the invention.
Figure 1B:
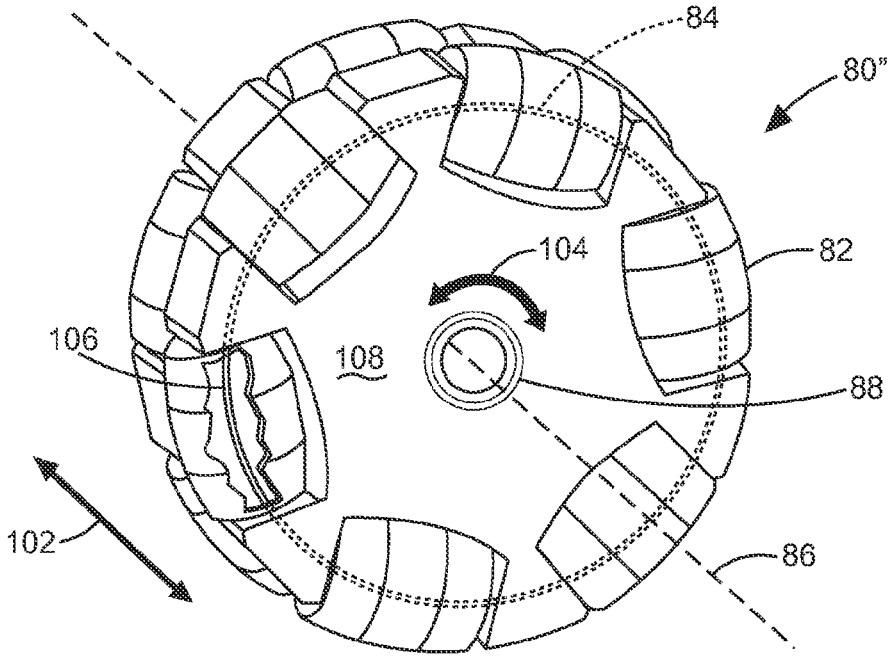

FIGS. 1A-1B illustrate sets of rollers 82 in perspective view, according to various embodiments of the invention. In FIGS. 1A and 1B, an omnidirectional wheel 80', 80" has a set of individual rollers 82 which share a primary axis 84 of rotation, so the wheel 80', 80" is capable of moving in the longitudinal direction 102. The rollers 82 also share a secondary axis 86 of rotation, providing the wheel 80', 80" with the capability of moving in the azimuthal direction 104. A bearing 88, such as a set of ball bearings (see FIG. 1A) or a sleeve bearing (see FIG. 1B) may be used to support motion around the secondary axis 86. In this way, the wheel 80', 80" enjoys two degrees of movement freedom.

Various mechanisms may be employed to comply with borehole roughness. For example, in FIG. 1A, a set of compliantly-curved spokes 100 are used to couple the primary and second axes 84, 86 of rotation. In FIG. 1B, axles 106, perhaps made from spring steel, are located substantially in line with the primary axis 84 of rotation and are used to compliantly mount individual rollers 82 to a rigid (e.g., made of metal) or compliant (e.g., made of rubber, fiber-composite, plastic, or polymer material) frame 108.

Figure 2:
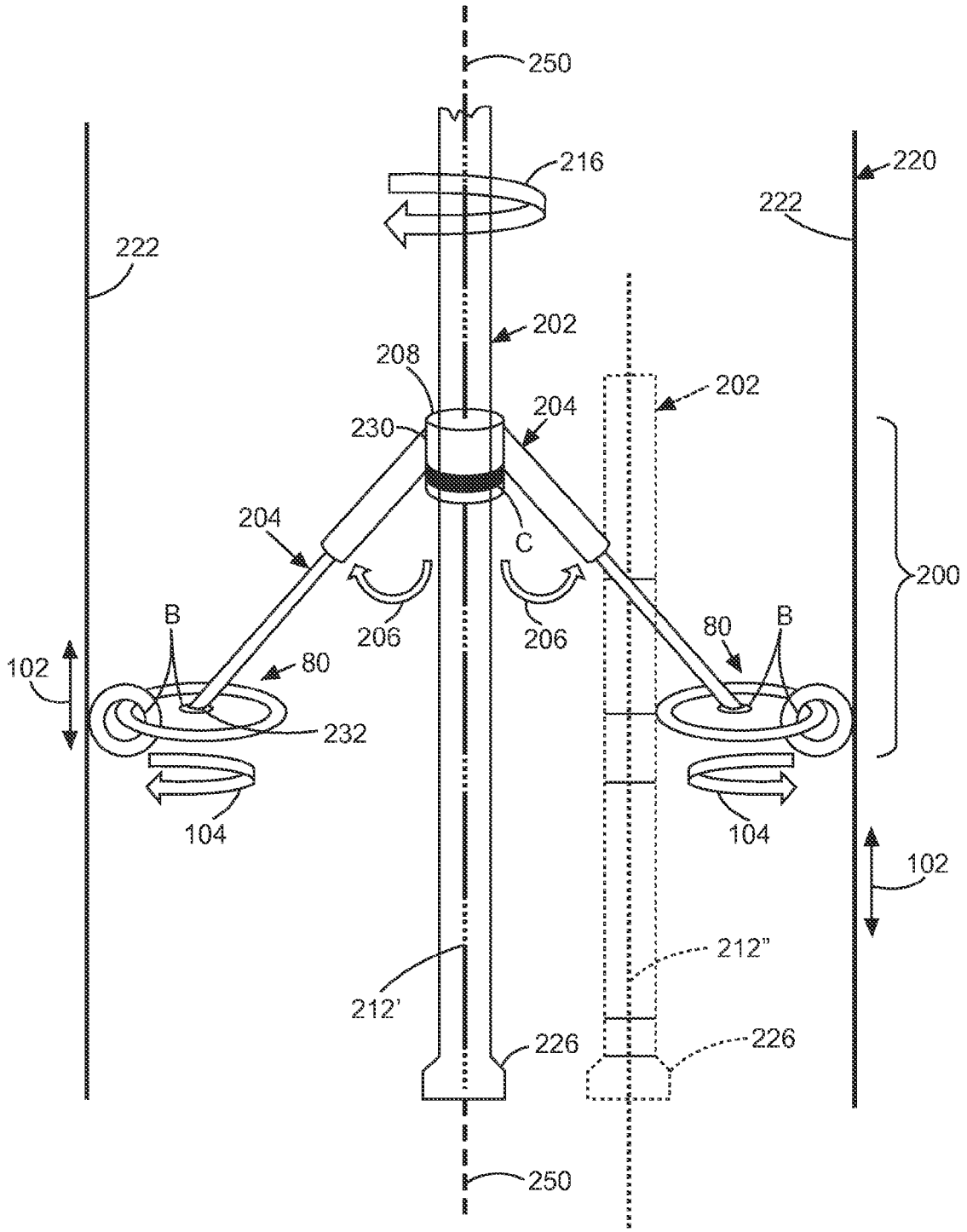
FIG. 2 illustrates a side view of an apparatus comprising extensible arms attached to a housing and sets of rollers according to various embodiments of the invention.

FIG. 2 illustrates a side view of an apparatus 200 comprising extensible arms 204 attached to a housing 202 and sets of rollers according to various embodiments of the invention. In this case, a potential LWD implementation is shown using multiple omniwheels 80 to construct an actively-controlled centralizer. Here, the arms 204 can swing out at the same, or different angles 206 with respect to housing 202. In an LWD environment, tool rotation dominates, therefore, the primary alignment axis 212' for the housing 202 centerline parallels (and coincides with) the longitudinal axis 250 of the borehole 220. Off-center rotation can be achieved (e.g., see the dashed housing 202 location, where the housing centerline 212" is aligned to rotate about the borehole axis 250) by individually adjusting the angle 206 of each arm 204, and/or the amount of its linear extension, which will allow drilling a bigger size borehole with a smaller size bit, or maintaining a constant tool offset distance within the borehole 220.

Different types of sensors can be used to provide information regarding the radial acceleration about the housing longitudinal axis 212' and the angle 206 of the arms 204. Forces on the arms 204 and the rotating speed of the housing 202 about the axis 212' can be used in feedback loops to minimize the radial acceleration and displacement of the tool axis 212'. A damping and spring mechanism can also be incorporated into each arm 204 to mechanically smooth the arm reaction to borehole rugosity on the borehole surface 222, allowing for the moment of inertia to take control. Thus, in some embodiments, such as when a borehole has an uneven radius, tool vibrations may be better controlled when the wheel (and rollers) travel along the largest virtual circle that fits within the hole, rather than allowing the wheel (and rollers) to follow the borehole surface profile.

For geosteering applications, brakes B and a clutch C can be used to reduce or halt rotation of the roller sets within the wheels 80', 80". This enhances the ability to fix the drilling axis (e.g., the housing centerline) at a desired location within the borehole 220, so that when the housing 202 centerline is moved from side to side (e.g., from alignment with the primary axis 212', to alignment with the secondary axis 212"), the bit 226 is actually able to bore a hole that is twice as large as the bit diameter. Thus, control using the brakes B and clutch C enables drilling a bigger hole with a smaller size bit, and the axis of rotation for the housing (e.g., the housing centerline) can be substantially fixed in space. That is, the clutch C can permit, or halt rotation of the arms 204 about the axis 212', and the brakes B can reduce or halt rotation of the sets of rollers (e.g., in the omnidirectional wheels 80) to limit movement along either one or both degrees of freedom. Thus, a variety of embodiments may be realized.

Figure 3:
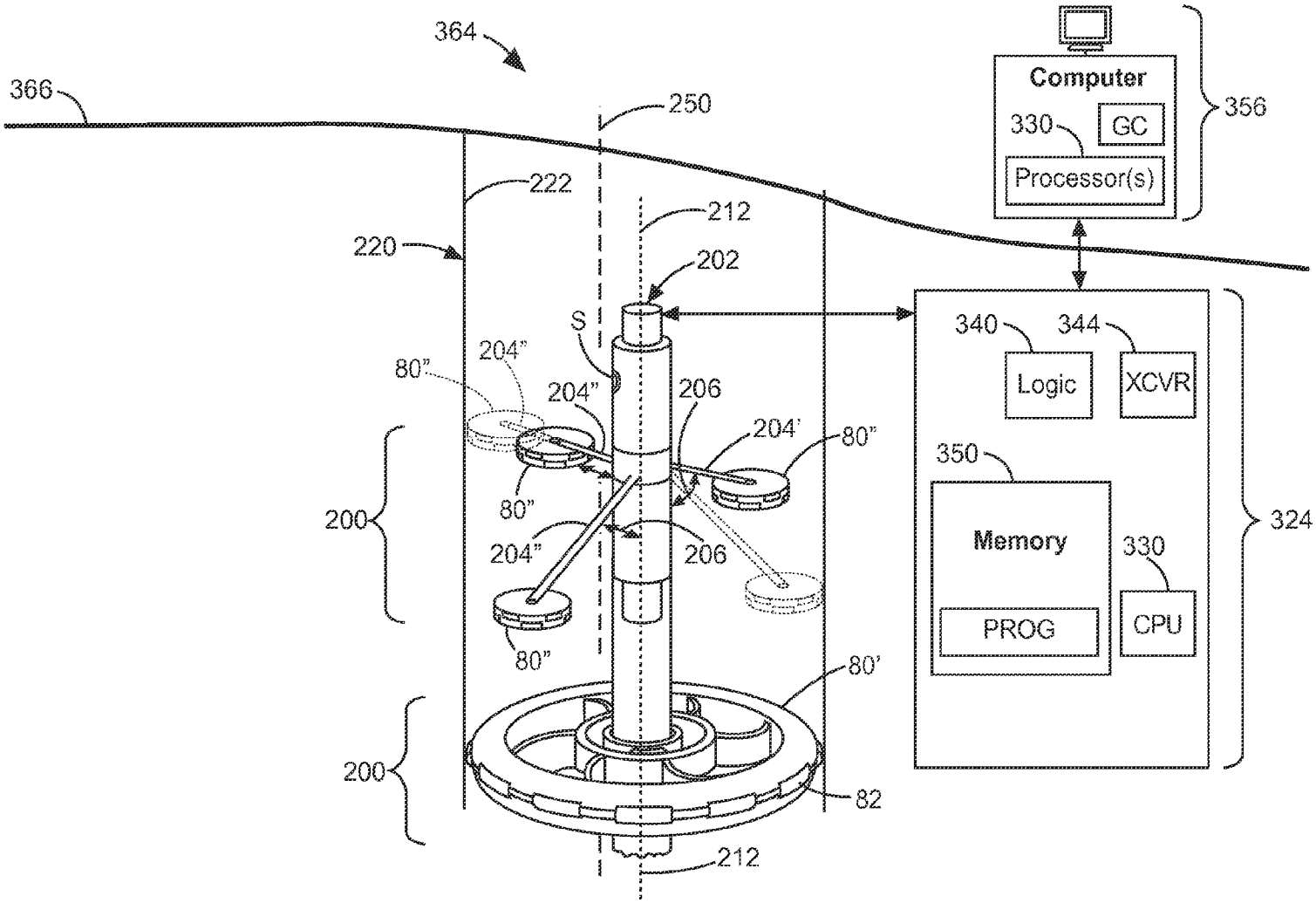
FIG. 3 is a block diagram of an apparatus and system according to various embodiments of the invention.

For example, FIG. 3 is a block diagram of an apparatus 200 and system 364 according to various embodiments of the invention. In this case, the apparatus 200 is illustrated using two different implementations of roller sets.

The first implementation uses three arms 204 that attach to the housing 202, with sets of rollers that make up three corresponding omnidirectional wheels 80". Two of the arms 204' are attached to the housing 202 as shown in FIG. 2, rotating about an attachment point to the housing 202 at an angle 206, and one of the arms 204" extends and retracts linearly (e.g., in a horizontal plane that is substantially orthogonal to the selected axis 212) between the housing 202 and the surface 222 of the borehole 220. Of course, different combinations of the arms 204 may be used, with either angular extension or linear extension, or some combinations of these, as shown. In addition, the arms 204' that move at an angle 206 can also be constructed to extend and retract in some embodiments. Sensors S are used to provide feedback to align the tool longitudinal axis with the selected axis 212 within the borehole 220, as described previously.

In the second implementation, a single wheel 80' is used to surround the housing 202. Compliantly-mounted rollers 82 are attached to the wheel 80'.

Combinations of the first and second implementation may be used to align the tool longitudinal axis with the selected axis 212, as shown here. In some embodiments, only one of the first or the second implementation is used.

In some embodiments, a system 364 comprises one or more of the apparatus 200, including one or more housings 202. The housings 202 might take the form of a wireline tool body, or a down hole tool. The system 364 may comprise one or more processors 330, which may accompany the apparatus 200 down hole. The processors 330 may be attached to the housing 202, and used to control the motion of the apparatus 200, perhaps accessing a memory 350 containing a program PROG that has instructions to process the feedback received from the sensors S, and to actuate a drive mechanism 208 coupled to the extensible arms 204', 204". In some embodiments, the processors 330 are located remotely from the apparatus 200.

A data transceiver may be used to transmit acquired data values and/or processing results to the surface 366, and to receive commands (e.g., motion control commands for the apparatus 200) from processors 330 on the surface 366. Thus, the system 364 may comprise the data transceiver 344 (e.g., a telemetry transceiver) to transmit/receive data and command values to/from a surface workstation 356.

Therefore, referring now to FIGS. 1-3, many embodiments may be realized. For example, in some embodiments, the apparatus 200 comprises a housing 202 and rollers 82 that provide two rotational degrees of freedom.

Some embodiments of the apparatus 200 may comprise a down hole housing 202 and at least one set of rollers 82 attached to the housing 202. The rollers 82 have two rotational degrees of freedom, to enable the housing 202 to move simultaneously along and about a longitudinal axis 212 within a borehole 220 in which the housing 202 is disposed, when the at least one set of rollers 82 contacts a surface 222 of the borehole 220.

The rollers 82 can share two axes 84, 86 of rotation. Thus, the set(s) of rollers 82 (e.g., a set of rollers 82 contained in an omnidirectional wheel) may comprise a plurality of individual rollers 82 that all share a primary axis 84 of rotation, and a secondary axis of 86 rotation different from the primary axis 84 of rotation.

The set(s) of rollers 82 can be attached to extensible arms 204. Thus, in some embodiments, the apparatus 200 comprises at least one extensible arm 204 attached at a first end 230 to the housing 202, and at a second end 232 to the at least one set of rollers 82.

An apparatus 200 may comprise multiple sets of rollers 82, perhaps used to provide a more stable platform for selecting an alignment axis 212 to be maintained as the housing 202 moves within the borehole 220. Thus, an apparatus 200 may comprise three sets of rollers, to provide a triangular vibration management platform.

The extensible arm(s) 204 can move in a plane. Thus, the extensible arm 204 may comprise a laterally extensible arm 204' that is hingedly attached to the housing at a first end 230 to move within a plane intersecting the center of rotation (e.g., the axis 212), and that is rotationally attached to a center of rotation of the at least one set of rollers (e.g., at or along the secondary axis 86 of rotation) at the second end 232.

The extensible arm(s) 204 can be constrained to move along a linear axis. Thus, the extensible arm 204 may comprise a laterally extensible arm 204" that is configured to move along a single linear axis.

The set(s) of rollers 82 may have individual rollers 82 mounted so as to rotate about a circular axis (e.g., the primary axis of rotation 84). Thus, one or more of the sets of rollers 82 in the apparatus 200 may comprise individual rollers 82 mounted to rotate about a substantially circular axis 84 forming a plane substantially perpendicular to the longitudinal axis of the housing 202.

The set(s) of rollers 82 may be located on a circle that does not include any part of the housing 202 (e.g., the wheels 80 shown in FIG. 2). Thus, the apparatus 200 may be constructed so that the housing 202 is not disposed within the substantially circular axis formed by the primary axis of rotation 84 with respect to individual sets of the rollers 82.

One or more sets of rollers 82 may surround the housing 202, being attached to the housing 202 with an azimuthal bearing 88. Thus, in some embodiments, the housing 202 is disposed within a substantially circular axis (e.g., the axis 84 of wheel 80') about which all individual rollers 82 in at least one set of rollers 82 can rotate.

The set(s) of rollers 82 may be mounted to a compliant mounting system, perhaps comprising a series of springs or hydraulic shock absorbers. Thus, in some embodiments, the apparatus 200 may comprise a compliant mounting system (e.g., including multiple compliant spokes 100 or axles 106) to permit the set(s) of rollers 82 to move toward a common center of rotation (e.g., the secondary axis 86) when uneven surfaces in the borehole 220 are encountered as the housing 202 moves along the selected longitudinal axis 212 within the borehole 220.

The apparatus 200 lends itself to use in a variety of systems. For example, in some embodiments, a system 364 comprises a housing 202, rollers 82, and a feed-back controlled extension mechanism 324. Thus, a system 364 may comprise a down hole housing 202, at least one set of rollers 82 attached to the housing 202 (with two rotational degrees of freedom), as described previously. The rollers 82 enable the housing 202 to move simultaneously along and about a longitudinal axis 212 within a borehole 220 in which the housing 202 is disposed, as the set(s) of rollers 82 contact a surface 222 of the borehole 220. The system 364 may further comprise an extension mechanism 324 controlled by feedback to selectably move a centerline of the housing 212 with respect to the longitudinal axis 250 within the borehole 220.

The extension mechanism 324 may comprise a drive mechanism 208, and one or more extensible arms 204. Thus, in some embodiments, the extension mechanism 324 comprises a drive mechanism 208 (e.g., to extend the arms 204 out and away from the housing 202, as shown in FIGS. 2 and 3), and at least one extensible arm 204 coupled to the drive mechanism 208 and the at least one set of rollers 82.

A geosteering controller can be used to operate the extension mechanism 324 remotely. Thus, the system 364 may comprise a remote geosteering controller GC, perhaps housed in the workstation 356, to operate the extension mechanism 324. A program PROG may be stored in the memory 350, which is accessed by the processors 330. Logic 340 may be used as an interface between the drive mechanism 208 of the apparatus 200 and the processors 330 and/or the geosteering controller GC. This arrangement can be used to control the apparatus 200, acquire measurement data, and generate signals to operate the drive mechanism 208.

A variety of sensors S can be used to provide the feedback that operates the extension mechanism 324. Thus, the feedback may be provided by sensors S comprising at least one of ultrasonic sensors, accelerometers, strain gauges, calipers, or optical sensors. Other sensors types may be used.

The housing centerline axis 212 may be substantially perpendicular to the axis of extension on the arms 204, as when the arms 204 comprise linearly extensible arms 204". Thus, in some embodiments, the centerline of the housing 212 is substantially perpendicular to an axis of extension (along the length of the arm 204") associated with the extension mechanism 324.

The housing 202 may comprise a variety of down hole devices. For example, the housing 202 may comprise a wireline tool body, an MWD down hole tool, or an LWD down hole tool.

Brakes B may be used to selectably reduce or halt the movement of individual rollers 82, or all of the rollers in a set. Therefore, the apparatus 200 (and therefore the system 364) may comprise a braking mechanism to slow or stop the movement of individual rollers 82, making up one or more sets of rollers 82.

A clutch C may be used to provide rotating attachment, or fixed attachment, of the extension mechanism 324 to the housing 202. Thus, a clutch C may be used to selectably couple the extension mechanism 324 to the housing 202 via rotating or fixed attachment. Still further embodiments may be realized.

Figure 4:
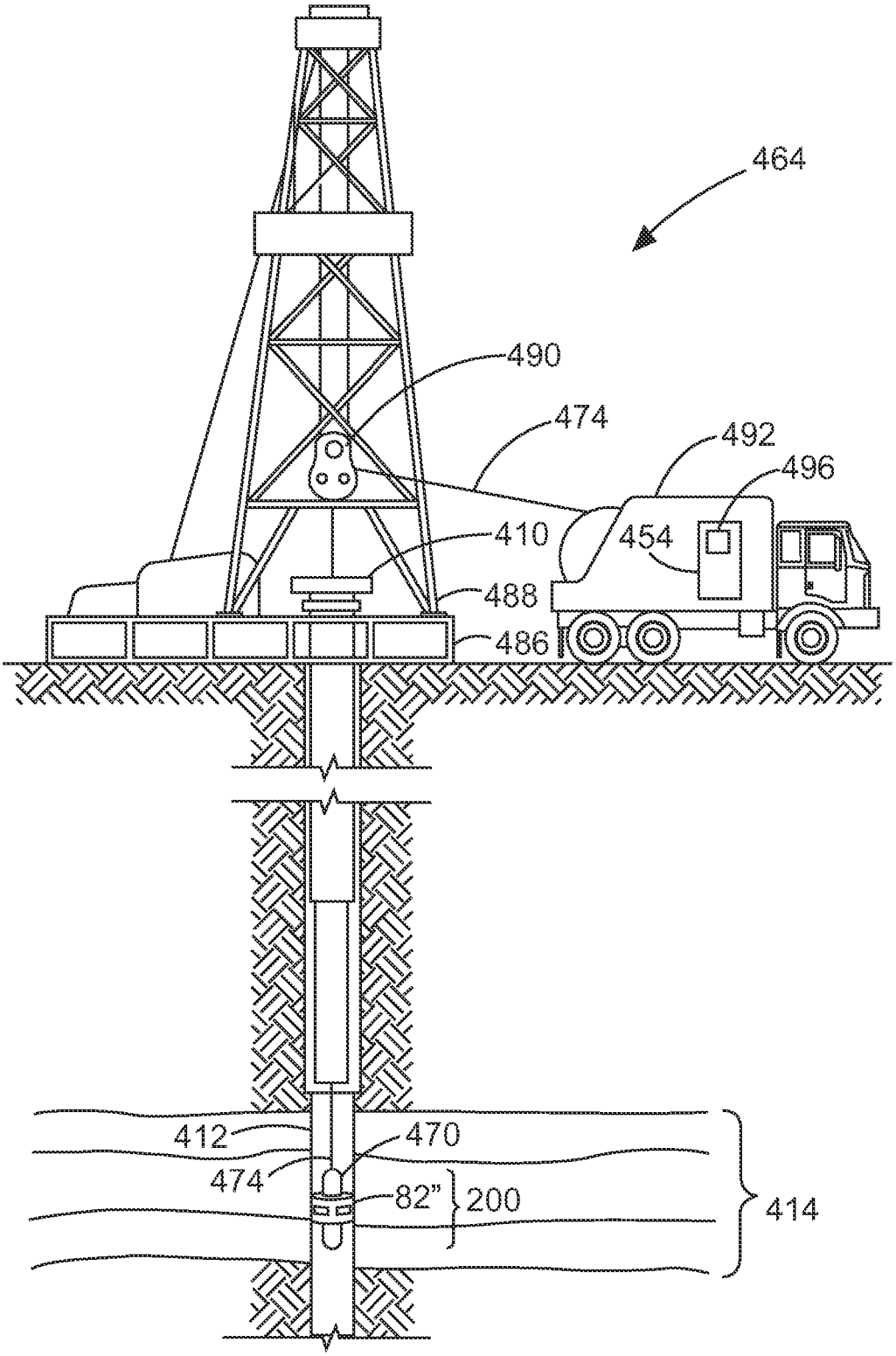
FIG. 4 illustrates a wireline system embodiment of the invention.
Figure 5:
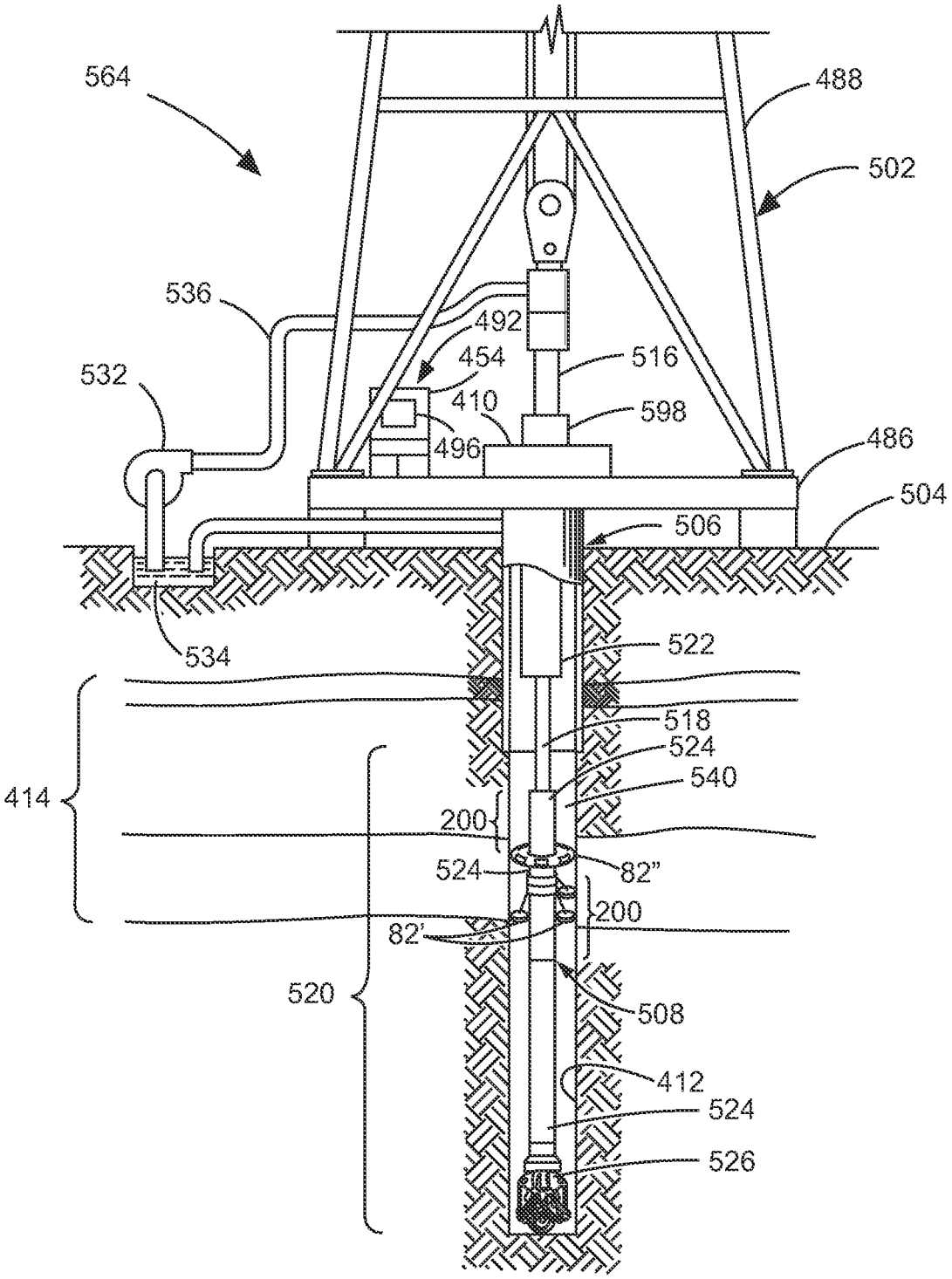
FIG. 5 illustrates a drilling rig system embodiment of the invention.

For example, FIG. 4 illustrates a wireline system 464 embodiment of the invention, and FIG. 5 illustrates a drilling rig system 564 embodiment of the invention. Thus, the systems 464, 564 may comprise portions of a wireline logging tool body 470 as part of a wireline logging operation, or of a down hole tool 524 as part of a down hole drilling operation.

Returning now to FIG. 4, it can be seen that a well is shown during wireline logging operations. In this case, a drilling platform 486 is equipped with a derrick 488 that supports a hoist 490.

Drilling oil and gas wells is commonly carried out using a string of drill pipes connected together so as to form a drilling string that is lowered through a rotary table 410 into a wellbore or borehole 412. Here it is assumed that the drilling string has been temporarily removed from the borehole 412 to allow a wireline logging tool body 470, such as a probe or sonde, to be lowered by wireline or logging cable 474 into the borehole 412. Typically, the wireline logging tool body 470 is lowered to the bottom of the region of interest and subsequently pulled upward at a substantially constant speed.

During the upward trip, at a series of depths the instruments (e.g., attached to the apparatus 200 or system 346 shown in FIGS. 1-3) included in the tool body 470 may be used to perform measurements on the subsurface geological formations 414 adjacent the borehole 412 (and the tool body 470). The measurement data can be communicated to a surface logging facility 492 for storage, processing, and analysis. The logging facility 492 may be provided with electronic equipment for various types of signal processing, which may be implemented by any one or more of the components of the apparatus 200 or system 346 in FIGS. 1-3. Similar formation evaluation data may be gathered and analyzed during drilling operations (e.g., LWD operations, and by extension, sampling while drilling). In this instance, the tool body 470 forms part of an apparatus 200 comprising an omnidirectional wheel 80", as shown in FIGS. 1B and 3.

In some embodiments, the tool body 470 comprises an acoustic tool for generating acoustic noise, and obtaining/analyzing acoustic noise measurements from a subterranean formation through a borehole. In some embodiments, the tool body 470 comprises an NMR tool. The tool is suspended in the wellbore by a wireline cable (e.g., wireline cable 474) that connects the tool to a surface control unit (e.g., comprising a workstation 454). The tool may be deployed in the borehole 412 on coiled tubing, jointed drill pipe, hard wired drill pipe, or any other suitable deployment technique.

Turning now to FIG. 5, it can be seen how a system 564 may also form a portion of a drilling rig 502 located at the surface 504 of a well 506. The drilling rig 502 may provide support for a drill string 508. The drill string 508 may operate to penetrate the rotary table 410 for drilling the borehole 412 through the subsurface formations 414. The drill string 508 may include a Kelly 516, drill pipe 518, and a bottom hole assembly 520, perhaps located at the lower portion of the drill pipe 518.

The bottom hole assembly 520 may include drill collars 522, a down hole tool 524, and a drill bit 526. The drill bit 526 may operate to create the borehole 412 by penetrating the surface 504 and the subsurface formations 414. The down hole tool 524 may comprise any of a number of different types of tools including MWD tools, LWD tools, and others.

During drilling operations, the drill string 508 (perhaps including the Kelly 516, the drill pipe 518, and the bottom hole assembly 520) may be rotated by the rotary table 410. Although not shown, in addition to, or alternatively, the bottom hole assembly 520 may also be rotated by a motor (e.g., a mud motor) that is located down hole. The drill collars 522 may be used to add weight to the drill bit 526. The drill collars 522 may also operate to stiffen the bottom hole assembly 520, allowing the bottom hole assembly 520 to transfer the added weight to the drill bit 526, and in turn, to assist the drill bit 526 in penetrating the surface 504 and subsurface formations 414.

During drilling operations, a mud pump 532 may pump drilling fluid (sometimes known by those of ordinary skill in the art as "drilling mud") from a mud pit 534 through a hose 536 into the drill pipe 518 and down to the drill bit 526. The drilling fluid can flow out from the drill bit 526 and be returned to the surface 504 through an annular area 540 between the drill pipe 518 and the sides of the borehole 412. The drilling fluid may then be returned to the mud pit 534, where such fluid is filtered. In some embodiments, the drilling fluid can be used to cool the drill bit 526, as well as to provide lubrication for the drill bit 526 during drilling operations. Additionally, the drilling fluid may be used to remove subsurface formation cuttings created by operating the drill bit 526.

Thus, referring now to FIGS. 1-5, it may be seen that in some embodiments, systems 364, 464, 564 may include a drill collar 522, a down hole tool 524, and/or a wireline logging tool body 470 attached to one or more apparatus 200 similar to or identical to the apparatus 200 described above and illustrated in FIGS. 1-3. Components of the system 364 in FIG. 3 may also be attached to the tool body 470 or the tool 524. In FIG. 5, for example, the tool 524 forms part of an apparatus 200 comprising an omnidirectional wheel 80", as shown in FIGS. 1B and 3, as well as to an apparatus 200 comprising multiple ones of the omnidirectional wheel 80', as shown in FIGS. 1A and 3.

Thus, for the purposes of this document, the term "housing" may include any one or more of a drill collar 522, a down hole tool 524, or a wireline logging tool body 470 (all having an outer wall, to enclose or attach to instrumentation, acoustic sources, sensors, fluid sampling devices, pressure measurement devices, transmitters, receivers, acquisition and processing logic, and data acquisition systems). The tool 524 may comprise a down hole tool, such as an LWD tool or MWD tool. As noted previously, the wireline tool body 470 may comprise a wireline logging tool, including a probe or sonde, for example, coupled to a logging cable 474.

In some embodiments, a system 464, 564 may include a display 496 to present feedback information from the apparatus 200, both measured and processed/calculated, perhaps in graphic form. A system 464, 564 may also include computation logic, perhaps as part of a surface logging facility 492, or a computer workstation 454, to receive signals from transmitters and receivers, and other instrumentation, to determine properties of the formation 414.

Thus, a system 364, 464, 564 may comprise a tubular housing 202, such as a down hole tool body, including a wireline logging tool body 470 or a down hole tool 524 (e.g., an LWD or MWD tool body), and one or more apparatus 200 attached to the tubular housing 202, the apparatus 200 to be constructed and operated as described previously.

The wheels 80; rollers 82; bearings 88; spokes 100; axles 106; frame 108; apparatus 200; housing 202; extensible arms 204; drive mechanism 208; boreholes 220, 412; borehole surfaces 222; drill bit 226, 526; extension mechanism 324; processors 330; transceiver 344; systems 364, 464, 564; workstations 356, 454; surface 366; rotary table 410; wireline logging tool body 470; logging cable 474; drilling platform 486; derrick 488; hoist 490; logging facility 492; display 496; drill string 508; Kelly 516; drill pipe 518; bottom hole assembly 520; drill collars 522; down hole tool 524; mud pump 532; mud pit 534; hose 536; brakes B; clutch C; geosteering controller GC; and sensors S may all be characterized as "modules" herein.

Such modules may include hardware circuitry, and/or a processor and/or memory circuits, software program modules and objects, and/or firmware, and combinations thereof, as desired by the architect of the apparatus 200 and systems 364, 464, 564 and as appropriate for particular implementations of various embodiments. For example, in some embodiments, such modules may be included in an apparatus and/or system operation simulation package, such as a software electrical signal simulation package, a power usage and distribution simulation package, a power/heat dissipation simulation package, and/or a combination of software and hardware used to simulate the operation of various potential embodiments.

It should also be understood that the apparatus and systems of various embodiments can be used in applications other than for drilling operations, and thus, various embodiments are not to be so limited. The illustrations of apparatus 200 and systems 364, 464, 564 are intended to provide a general understanding of the structure of various embodiments, and they are not intended to serve as a complete description of all the elements and features of apparatus and systems that might make use of the structures described herein.

Applications that may include the novel apparatus and systems of various embodiments include electronic circuitry used in high-speed computers, communication and signal processing circuitry, modems, processor modules, embedded processors, data switches, and application-specific modules. Such apparatus and systems may further be included as sub-components within a variety of electronic systems, such as televisions, cellular telephones, personal computers, workstations, radios, video players, vehicles, signal processing for geothermal tools and smart transducer interface node telemetry systems, among others. Some embodiments include a number of methods.

Figure 6:
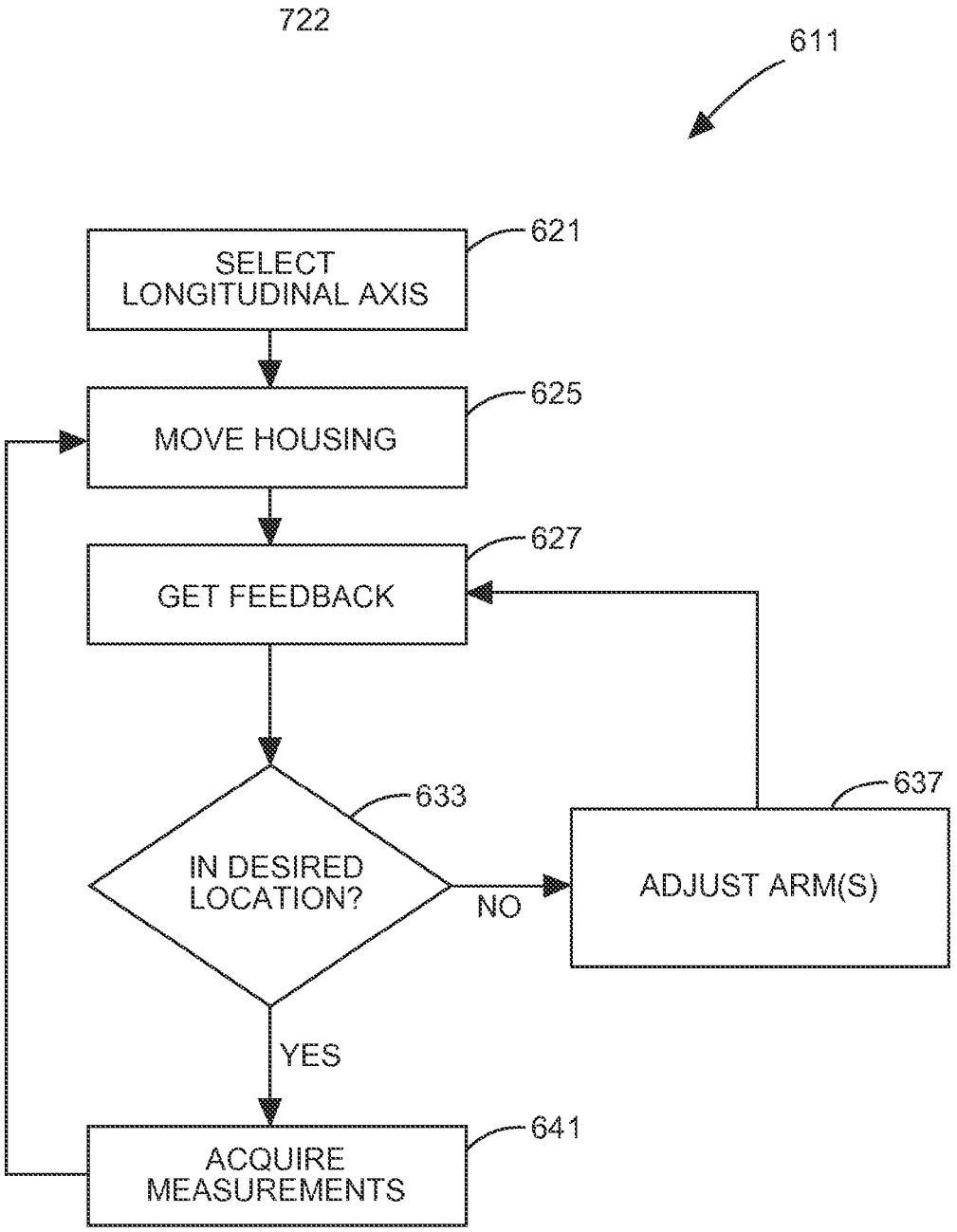
FIG. 6 is a flow chart illustrating several methods according to various embodiments of the invention.

For example, FIG. 6 is a flow chart illustrating several methods 611 according to various embodiments of the invention. In some embodiments, a method 611 may begin at block 621 with selecting a longitudinal axis within a borehole. The method 611 may continue on to block 625 with moving a down hole housing using at least one set of rollers attached to the housing to contact a surface of the borehole, so that simultaneous movement with two rotational degrees of freedom is enabled within the borehole as the centerline of the housing is substantially aligned with the selected longitudinal axis within the borehole while the housing moves along the selected longitudinal axis.

Moving the housing can involve shared movement of the rollers about two axes. Thus, the activity at block 625 may comprise moving substantially all of the rollers (separately or together) about a shared, substantially circular axis of rotation to enable the housing to move along the selected longitudinal axis. The activity at block 625 may also comprise moving substantially all of the rollers together along the substantially circular axis of rotation.

Moving the housing can involve receiving feedback to control the position of one or more arms attached to the housing. Thus, the method 611 may continue on to block 627 to include receiving electrical feedback with respect to the moving.

The feedback can represent vibration or location information that is associated with the housing. Thus, the electrical feedback may represent vibration measurement and/or location measurement.

At block 633, the method 611 may operate to determine whether the housing that forms part of the various apparatus described herein is at the desired location (e.g., whether the centerline of the housing is substantially aligned, to within some desired distance, to the selected longitudinal axis in the borehole), or not. If so, then the method 611 may continue on to block 641, to include acquiring desired measurements, and conducting other activities using instrumentation and apparatus attached to the down hole housing. If not, then the method 611 may continue on to block 637 to include adjusting the position of at least one arm (e.g., an extensible arm) attached to the center of rotation (e.g., the axis 86 in FIGS. 1A and 1B) of one or more sets of rollers to move the centerline toward the selected longitudinal axis.

It should be noted that the methods described herein do not have to be executed in the order described, or in any particular order. Moreover, various activities described with respect to the methods identified herein can be executed in iterative, serial, or parallel fashion. The various elements of each method can be substituted, one for another, within and between methods. Information, including parameters, commands, operands, and other data, can be sent and received in the form of one or more carrier waves.

Upon reading and comprehending the content of this disclosure, one of ordinary skill in the art will understand the manner in which a software program can be launched from a computer-readable medium in a computer-based system to execute the functions defined in the software program. One of ordinary skill in the art will further understand the various programming languages that may be employed to create one or more software programs designed to implement and perform the methods disclosed herein. For example, the programs may be structured in an object-orientated format using an object-oriented language such as Java or C#. In some embodiments, the programs can be structured in a procedure-orientated format using a procedural language, such as assembly or C. The software components may communicate using any of a number of mechanisms well known to those skilled in the art, such as application program interfaces or interprocess communication techniques, including remote procedure calls. The teachings of various embodiments are not limited to any particular programming language or environment. Thus, other embodiments may be realized.

Figure 7:
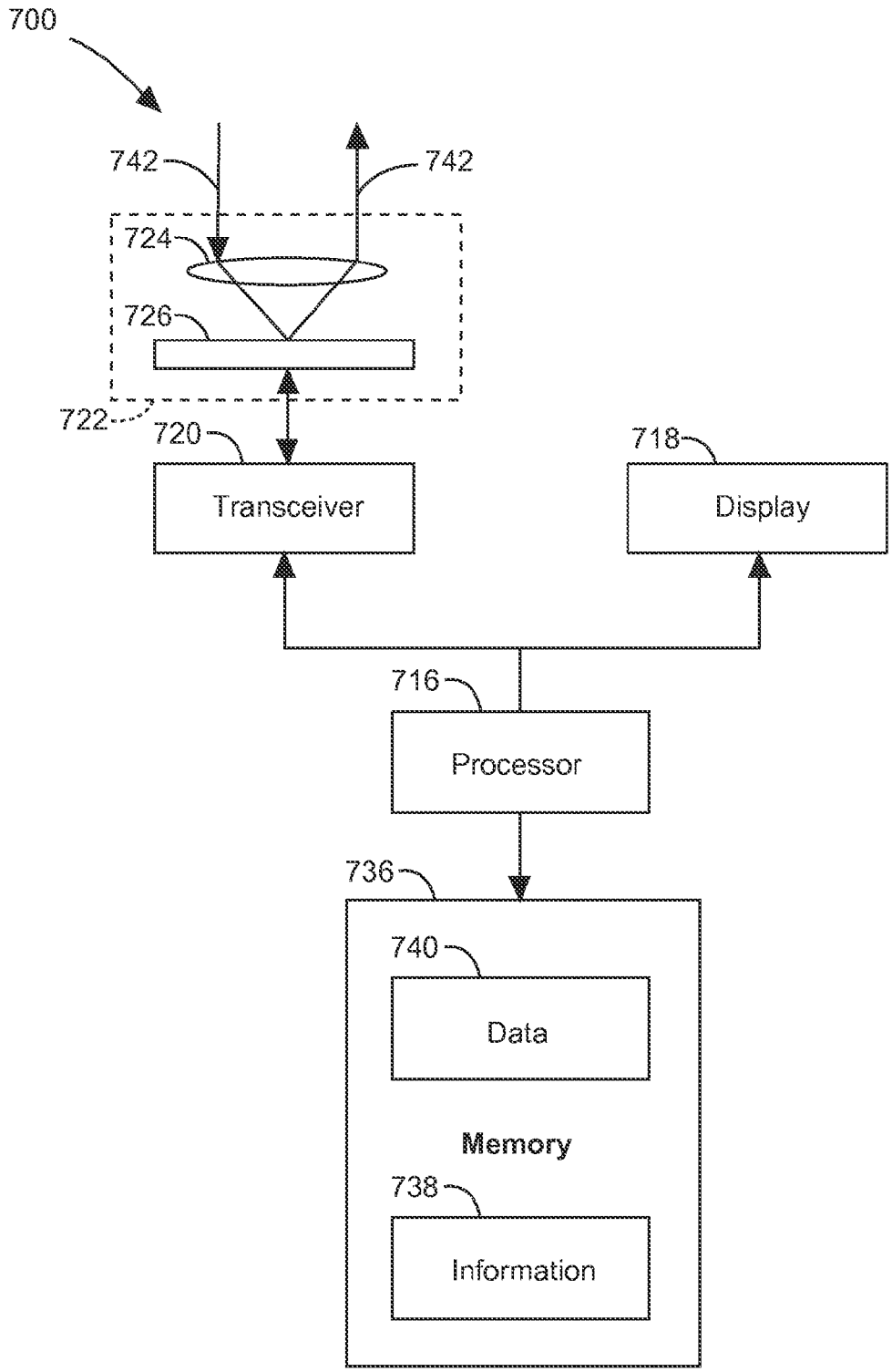
FIG. 7 is a block diagram of an article according to various embodiments of the invention.

For example, FIG. 7 is a block diagram of an article 700 of manufacture according to various embodiments, such as a computer, a memory system, a magnetic or optical disk, or some other storage device. The article 700 may include one or more processors 716 coupled to a machine-accessible medium such as a memory 736 (e.g., removable storage media, as well as any tangible, non-transitory memory including an electrical, optical, or electromagnetic conductor) having associated information 738 (e.g., computer program instructions and/or data), which when executed by one or more of the processors 716, results in a machine (e.g., the article 700) performing any of the actions described with respect to the methods of FIG. 6, the apparatus of FIGS. 1-2, and the systems of FIGS. 3-5. The processors 716 may comprise one or more processors sold by Intel Corporation (e.g., Intel® Core™ processor family), Advanced Micro Devices (e.g., AMD Athlon™ processors), and other semiconductor manufacturers.

In some embodiments, the article 700 may comprise one or more processors 716 coupled to a display 718 to display data processed by the processor 716 and/or a wireless transceiver 720 (e.g., a down hole telemetry transceiver) to receive and transmit data processed by the processor.

The memory system(s) included in the article 700 may include memory 736 comprising volatile memory (e.g., dynamic random access memory) and/or non-volatile memory. The memory 736 may be used to store data 740 processed by the processor 716.

In various embodiments, the article 700 may comprise communication apparatus 722, which may in turn include amplifiers 726 (e.g., preamplifiers or power amplifiers) and one or more antennas 724 (e.g., transmitting antennas and/or receiving antennas). Signals 742 received or transmitted by the communication apparatus 722, including feedback signals, may be processed according to the methods described herein.

Many variations of the article 700 are possible. For example, in various embodiments, the article 700 may comprise a down hole tool, including the apparatus 200 shown in FIG. 2. In some embodiments, the article 700 is similar to or identical to the apparatus 200 or systems 346, 446, 546 shown in FIGS. 3-5.

In summary, using the apparatus, systems, and methods disclosed herein may operate to reduce vibration induced by drilling and other down hole activity, by smoothing and/or damping radial movements using active alignment of the housing axis, while providing a more substantial contact with the wall of the borehole. Reduced vibration has many benefits, including improved LWD tool reliability, and better measurement quality, significantly enhancing the value of services provided by an operation and exploration company.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment.

What is claimed is:

1. An apparatus, comprising:

a down hole housing; and at least one set of rollers attached to the housing and having two rotational degrees of freedom, to enable the housing to move simultaneously along and about a longitudinal axis within a borehole in which the housing is disposed, when the at least one set of rollers contacts a surface of the borehole;

wherein each roller of the at least one set of rollers is compliantly mounted to a frame, each roller having an axle located substantially in line with a substantially circular axis of rotation.

2. The apparatus of claim 1, wherein the at least one set of rollers comprises a plurality of individual rollers that all share a primary axis of rotation, and a secondary axis of rotation different from the primary axis of rotation.

3. The apparatus of claim 1, further comprising:

at least one extensible arm attached at a first end to the housing, and at a second end to the at least one set of rollers.

4. The apparatus of claim 3, wherein the at least one set of rollers comprises:

three sets of rollers.

5. The apparatus of claim 3, wherein the extensible arm comprises:

a laterally extensible arm that is configured to move along a single linear axis.

6. The apparatus of claim 3, wherein the extensible arm comprises:

a laterally extensible arm that is hingedly attached to the housing at the first end to move within a plane intersecting a center of rotation of the housing, and that is rotationally attached to a center of rotation of the at least one set of rollers at the second end.

7. The apparatus of claim 1, wherein the at least one set of rollers comprises:

individual rollers mounted to rotate about the substantially circular axis forming a plane substantially perpendicular to the longitudinal axis.

8. The apparatus of claim 7, wherein the housing is not disposed within the substantially circular axis.

9. The apparatus of claim 1, further comprising:

a compliant mounting system to permit the at least one set of rollers to move toward a common center of rotation when uneven surfaces in the borehole are encountered as the housing moves along the longitudinal axis.

10. The apparatus of claim 9, wherein the compliant mounting system includes the axle.

11. A system, comprising:

a down hole housing;

at least one set of rollers attached to the housing and having two rotational degrees of freedom to enable the housing to move simultaneously along and about a longitudinal axis within a borehole in which the housing is disposed when the at least one set of rollers contacts a surface of the borehole, rollers of the at least one set of rollers further including a compliant axle mounted to a frame; and an extension mechanism controlled by feedback to selectably move a centerline of the housing with respect to the longitudinal axis within the borehole.

12. The system of claim 11, wherein the extension mechanism comprises:

a drive mechanism; and at least one extensible arm coupled to the drive mechanism and the at least one set of rollers.

13. The system of claim 11, comprising:

a remote geosteering controller to operate the extension mechanism.

14. The system of claim 11, wherein the housing is disposed within a substantially circular axis about which all individual rollers in the at least one set of rollers can rotate.

15. The system of claim 11, wherein the feedback is provided by sensors comprising at least one of ultrasonic sensors, accelerometers, strain gauges, or optical sensors.

16. The system of claim 11, wherein the centerline of the housing is substantially perpendicular to an axis of extension associated with the extension mechanism.

17. The system of claim 11, wherein the housing comprises:

one of a wireline tool body, a measurement while drilling down hole tool, or a logging while drilling down hole tool.

18. The system of claim 11, further comprising:

a braking mechanism to slow or stop movement of individual rollers in the at least one set of rollers.

19. The system of claim 11, further comprising:

a clutch mechanism to selectably couple the extension mechanism to the housing via rotating or fixed attachment.

20. A method, comprising:

selecting a longitudinal axis within a borehole;

moving a down hole housing using at least one set of rollers attached to the housing to contact a surface of the borehole, so that simultaneous movement of the at least one set of rollers with two rotational degrees of freedom is enabled within the borehole as a centerline of the housing is substantially aligned with the selected longitudinal axis while the housing moves along the selected longitudinal axis; and moving each roller of the at least one set of rollers about an axle, each roller compliantly mounted to a frame and located substantially in line with a substantially circular axis of rotation.

21. The method of claim 20, wherein the moving comprises:

moving substantially all of the rollers about the substantially circular axis of rotation to enable the housing to move along the selected longitudinal axis; and moving substantially all of the rollers along the substantially circular axis of rotation.

22. The method of claim 20, wherein the moving comprises:

receiving electrical feedback with respect to the moving; and adjusting a position of at least one arm attached to a center of rotation for the at least one set of rollers to move the centerline toward the selected longitudinal axis.

23. The method of claim 22, wherein the electrical feedback represents one of vibration measurement or location measurement.

* * * * *